US011220841B2

(12) United States Patent
Fenini

(10) Patent No.: US 11,220,841 B2
(45) Date of Patent: Jan. 11, 2022

(54) KEY FOR A LOCK AND A COMBINATION OF A CYLINDER LOCK AND A REVERSIBLE FLAT KEY

(71) Applicant: ISEO SERRATURE S.P.A., Pisogne (IT)

(72) Inventor: Sandro Fenini, Esine (IT)

(73) Assignee: ISEO SERRATURE S.P.A., Pisogne (IT)

( * ) Notice: Subject to any disclaimer, the term of this patent is extended or adjusted under 35 U.S.C. 154(b) by 296 days.

(21) Appl. No.: 16/493,268

(22) PCT Filed: Jan. 2, 2018

(86) PCT No.: PCT/EP2018/050083

§ 371 (c)(1),
(2) Date: Sep. 11, 2019

(87) PCT Pub. No.: WO2018/166662

PCT Pub. Date: Sep. 20, 2018

(65) Prior Publication Data

US 2020/0032549 A1 Jan. 30, 2020

(30) Foreign Application Priority Data

Mar. 15, 2017 (IT) ..... 102017000028885

(51) Int. Cl.

| | |
|---|---|
| ***E05B 35/00*** | (2006.01) |
| ***E05B 19/00*** | (2006.01) |
| ***E05B 27/00*** | (2006.01) |
| ***E05B 47/00*** | (2006.01) |
| ***E05B 27/10*** | (2006.01) |

(52) U.S. Cl.

CPC ..... *E05B 35/004* (2013.01); *E05B 19/0058* (2013.01); *E05B 19/0064* (2013.01);
(Continued)

(58) Field of Classification Search

CPC .. E05B 19/00; E05B 19/0017; E05B 19/0052; E05B 19/0058; E05B 19/0064;
(Continued)

(56) References Cited

U.S. PATENT DOCUMENTS 5,170,651 A * 12/1992 Errani ..... E05B 35/004 70/493
5,724,841 A * 3/1998 Botteon ..... E05B 35/004 70/395

(Continued)

FOREIGN PATENT DOCUMENTS

DE 102014010707 1/2016
EP 0890694 1/1999

(Continued)

OTHER PUBLICATIONS

International Search Report for PCT/EP2018/050083, dated Mar. 15, 2018.

*Primary Examiner* — Christopher J Boswell
(74) *Attorney, Agent, or Firm* — Knobbe, Martens, Olson & Bear, LLP

(57) ABSTRACT

The key (1) for a lock (2), comprises at least a lever (9) having a first arm (10) for starting movement and a second arm (11) for activating a tumbler element of the lock (2), the lever (9) being pivoted to the shaft (4) of the key (1) with an oscillating axis thereof being transversal to the longitudinal axis of the shaft (4) of the key (1), the first lever arm (10) and the second lever arm (11) being located on a same face (5) of the shaft (4) of the key (1).

12 Claims, 5 Drawing Sheets

(52) U.S. Cl.
CPC ..... *E05B 27/0021* (2013.01); *E05B 27/10* (2021.08); *E05B 35/003* (2013.01); *E05B 47/0045* (2013.01); *E05B 47/0038* (2013.01)

(58) Field of Classification Search
CPC .. E05B 19/18; E05B 27/0017; E05B 27/0021; E05B 27/0057; E05B 27/0071; E05B 27/10; E05B 35/003; E05B 35/004; E05B 35/005; E05B 47/0038; E05B 47/0044; E05B 47/0045
See application file for complete search history.

(56) References Cited

U.S. PATENT DOCUMENTS

| | | | | |
|---|---|---|---|---|
| 5,775,144 | A * | 7/1998 | Pagalday | E05B 35/004 70/358 |
| 7,647,799 | B2 * | 1/2010 | Markbreit | E05B 35/004 70/409 |
| 8,820,129 | B2 * | 9/2014 | Dolev | E05B 35/003 70/409 |
| 8,950,226 | B2 * | 2/2015 | Dolev | E05B 35/003 70/399 |
| 2006/0272372 | A1 * | 12/2006 | Talamonti | E05B 35/004 70/358 |
| 2016/0265248 | A1 * | 9/2016 | Karpfen | E05B 35/004 |

FOREIGN PATENT DOCUMENTS

| | | |
|---|---|---|
| EP | 3103944 | 12/2016 |
| WO | WO2015/063755 | 5/2015 |
| WO | WO2016/098133 | 6/2016 |

* cited by examiner

KEY FOR A LOCK AND A COMBINATION OF A CYLINDER LOCK AND A REVERSIBLE FLAT KEY

CROSS-REFERENCE TO RELATED APPLICATIONS

This application is the U.S. National Phase of International Application No. PCT/EP2018/050083 entitled A KEY FOR A LOCK AND A COMBINATION OF A CYLINDER LOCK AND A REVERIBLE FLAT KEY, filed Jan. 2, 2018, and published on Sep. 20, 2018, as WO 2018/166662, which claims the benefit of, and priority to, Italian patent application no. 102017000028885, filed Mar. 15, 2017, the entire contents of which are incorporated by reference herein.

The present invention relates to key for a lock, especially but not necessarily a reversible flat key for a cylinder lock.

Keys of various nature have been present on the market for a long time, flat or bitted, reversible or not, having a bit combining teeth, hollows, crests and mobile elements configured and arranged to interact with the tumbler elements present in the lock.

It is obviously possible to make the key extremely secure with an adequate design of the combination of the elements making up the bit thereof.

In some cases the bit elements of the key are crests fixed projecting from the plane of the key which can represent an obstacle when the key has been introduced in specific types of cylinder lock in which the base of the cylindrical rotor is covered by an appropriate protection disc.

A key with a simpler bit, for example without fixed elements projecting from the plane of the key, might eliminate the above-mentioned drawback but at the same time might also be more exposed to fraudulent duplication.

As mentioned there exist keys in which the bit has a mobile element which however for construction reasons is constrained to a very limited displacement, not always sufficient to guarantee a reliable and effective functioning.

The technical task of the present invention is, therefore, to provide a key for a lock which obviates the above-described technical drawbacks of the prior art.

Within the context of this technical task an object of the invention is to realise a high-security key for a lock.

A further object of the invention is to realise a key for a lock that is practical and easy to use.

Another object of the invention is to realise a key for a lock that is difficult to duplicate.

Another object of the invention is to realise a key for a lock that is reliable and sturdy.

The technical task, as well as these and other objects according to the present invention, are attained by a key for a lock of a door or window, characterised in that it comprises at least a lever having a first arm for starting movement and a second arm for activating a tumbler element of the lock, said lever being pivoted to the shaft of the key with an oscillating axis thereof being transversal to the longitudinal axis of the shaft of the key, said first lever arm and said second lever arm being located on a same face of the shaft of the key.

The lever is advantageously housed in a groove of the face of the shaft of the key. In an idle position thereof, said lever is advantageously positioned entirely inside of said groove.

Further, said second arm advantageously has a greater length than said first arm so as to amplify the displacement of the tumbler element.

In a preferred embodiment the key is a reversible flat key and the lock is a cylinder lock.

Other characteristics of the present invention are further defined in the remaining dependent claims.

The key of the invention therefore does not have fixed elements projecting from the plane of the key and is usable unproblematically in applications which have cylinder locks with the cylindrical rotor protected by a protection disc.

The provision of an oscillating lever further makes fraudulent duplication of the key extremely complex.

The lever has a rocker movement which amplifies the travel of the second lever arm and therefore the engagement of the tumbler element of the lock.

In this way the lever functions with extreme effectiveness and reliability for activating the tumbler element of the lock.

Further characteristics and advantages of the invention will more fully emerge from the description of a preferred but not exclusive embodiment of the key for a lock according to the invention, illustrated by way of non-limiting example in the accompanying figures of the drawings, in which.

Figure 1:
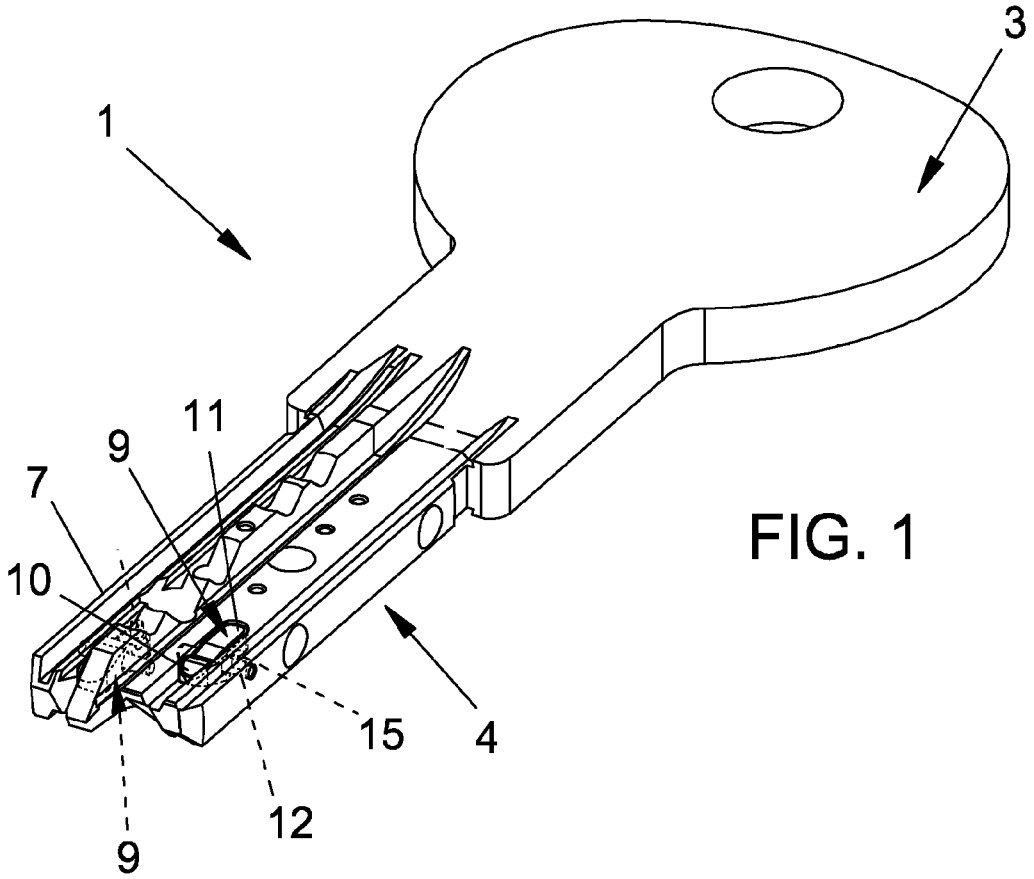
FIG. 1 shows a perspective view of a reversible flat key, in a preferred embodiment of the invention.
Figure 2:
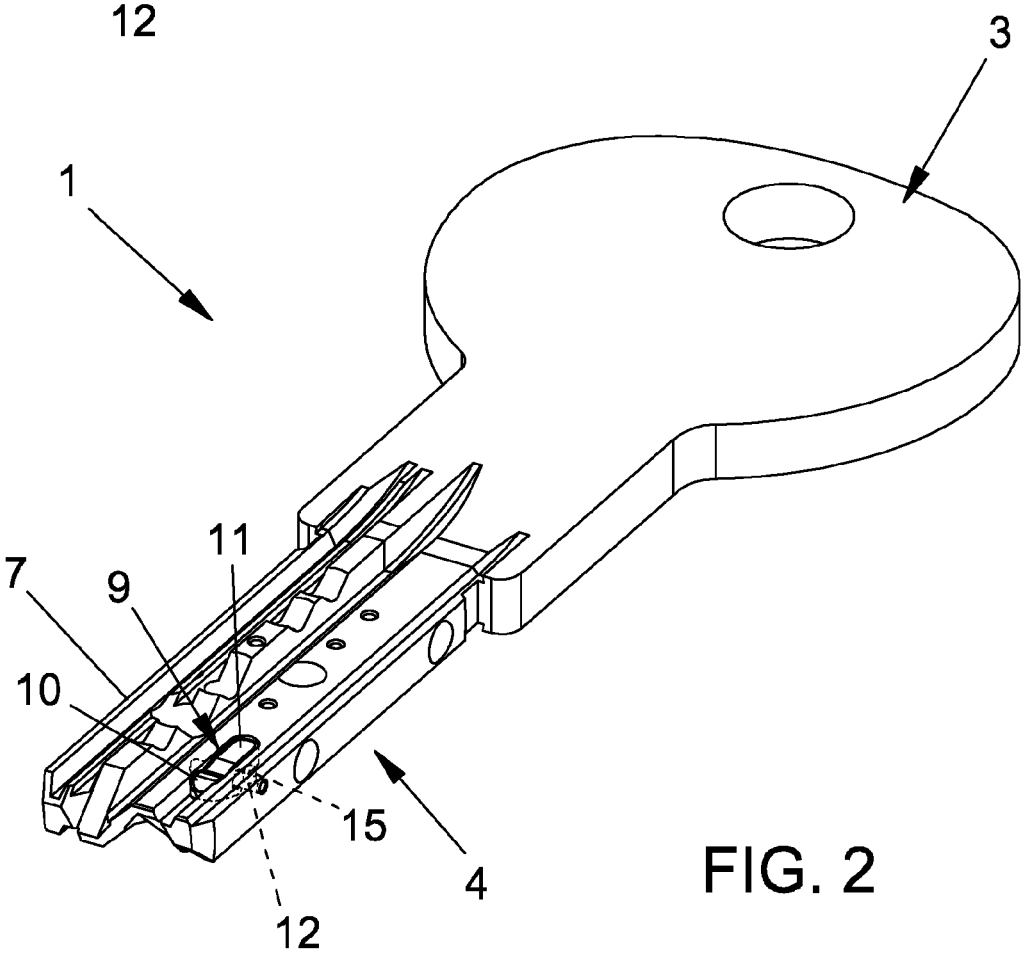
FIG. 2 shows the two levers included on the two opposite main faces of the shaft of the flat key of FIG. 1.
Figure 3:
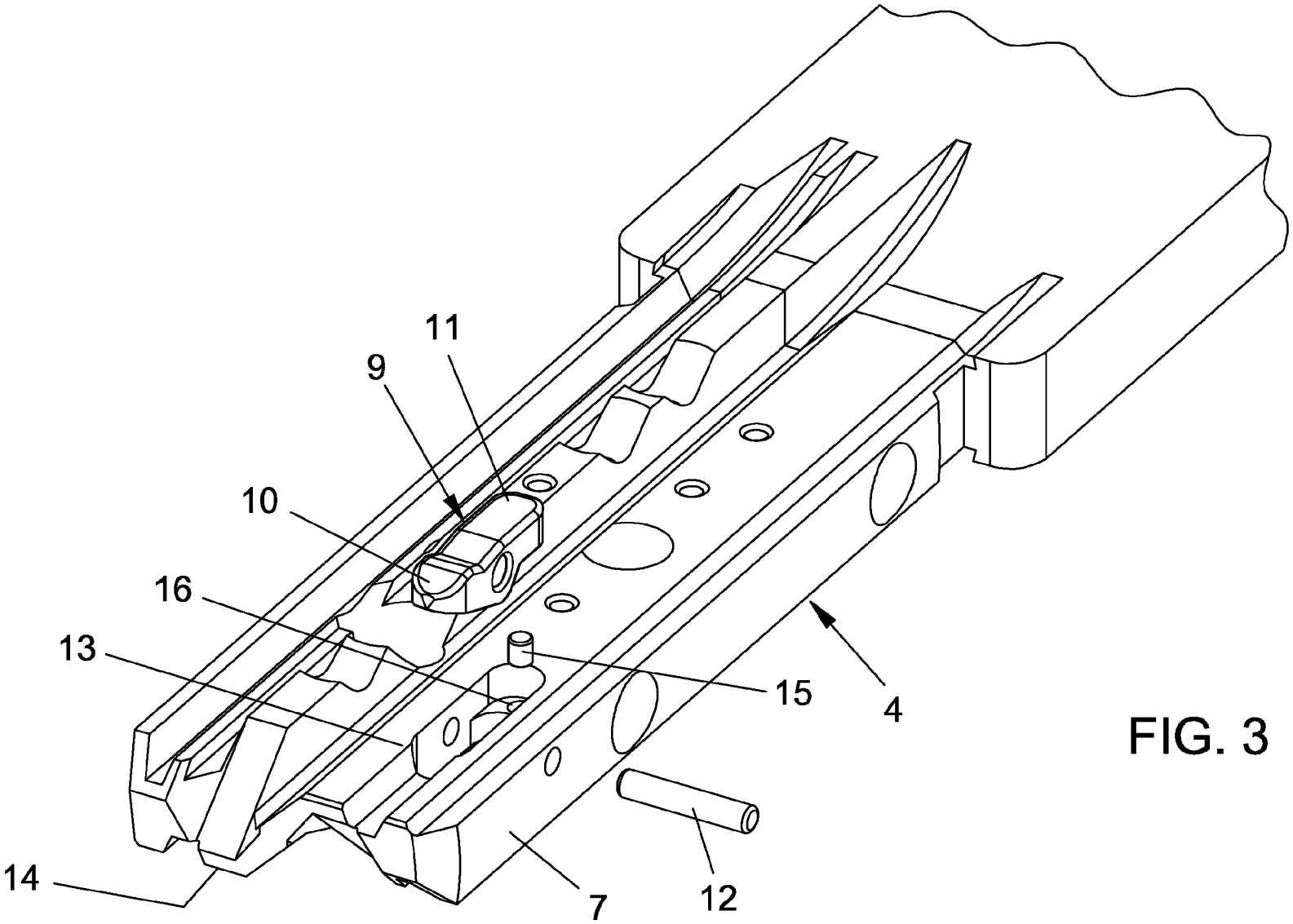
FIG. 3 is an exploded view of the key of FIG. 1.
Figure 4A:
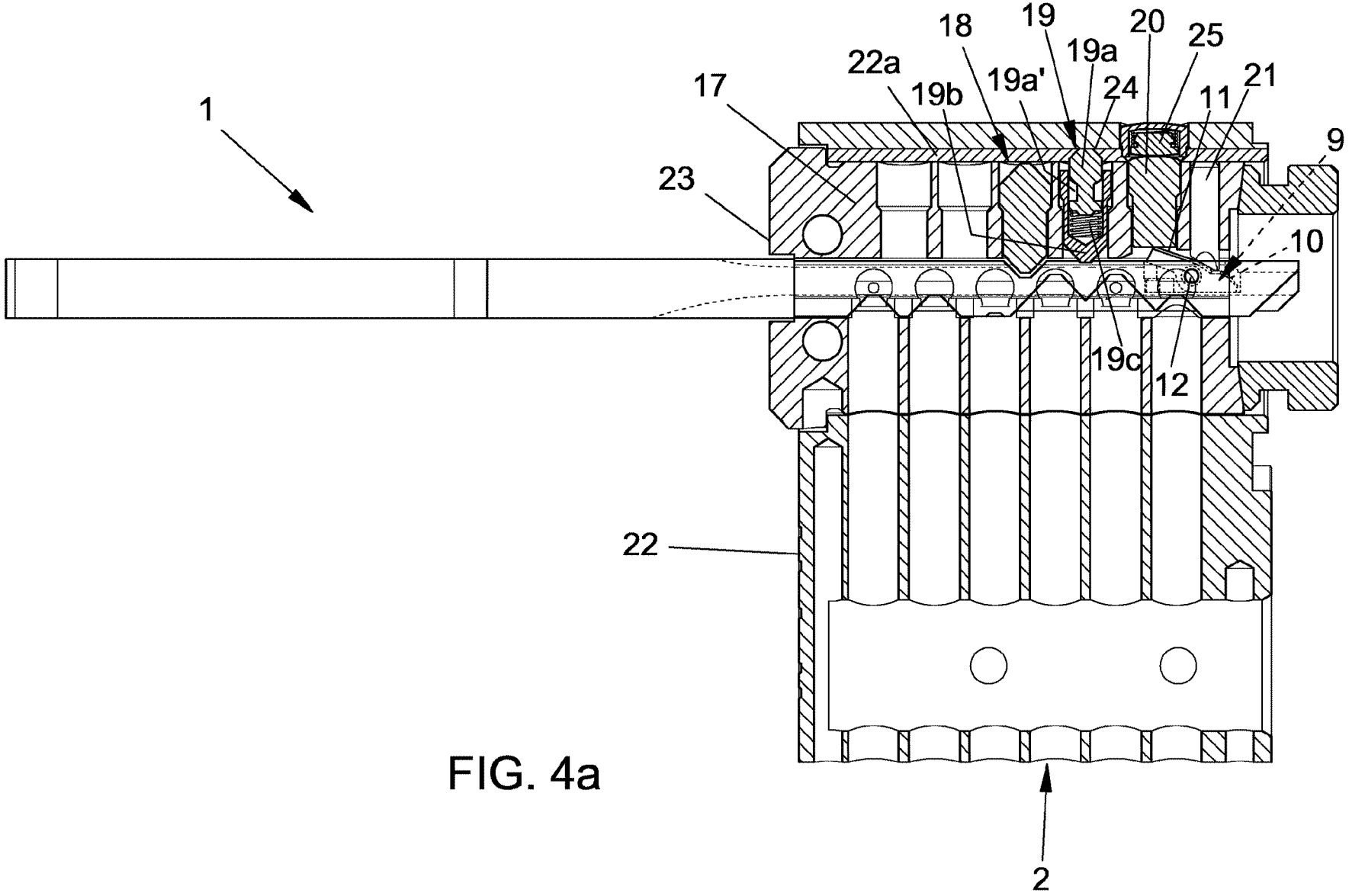
Figure 4B:
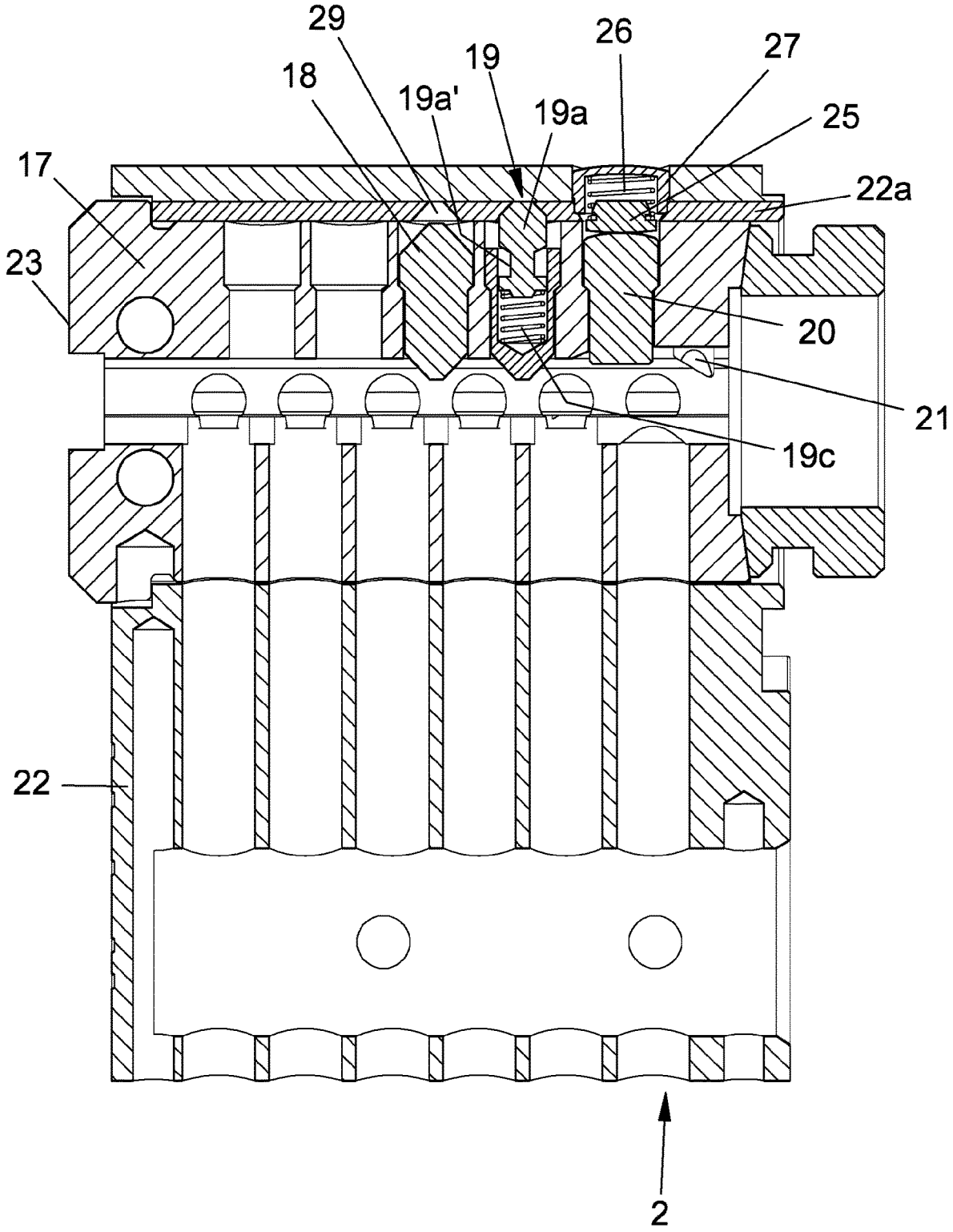
Figure 5:
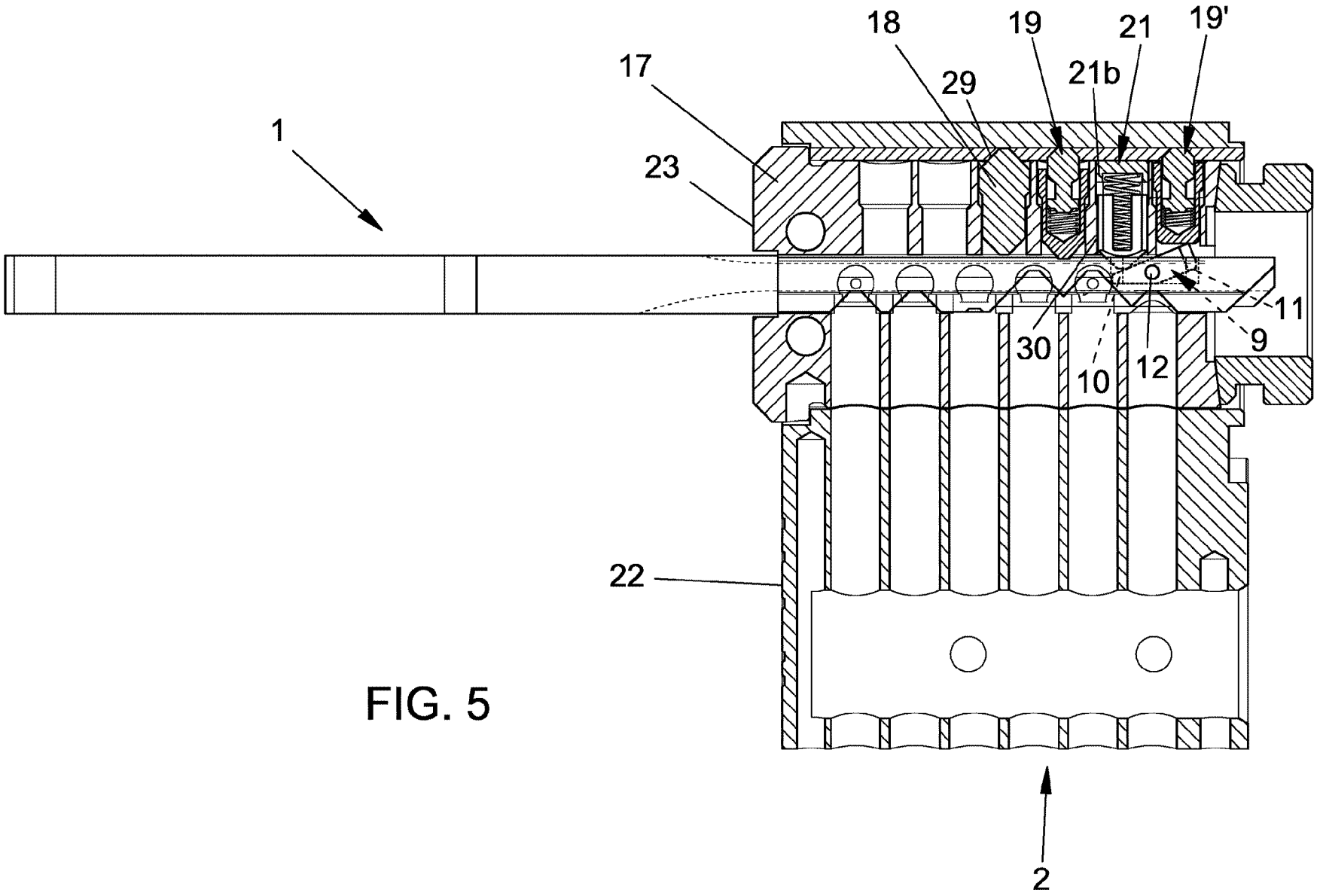

FIG. 4*a* shows the reversible flat key of FIG. 1 inserted in a cylinder lock;

FIG. 4*b* shows the cylinder lock of FIG. 4*a* with the key removed; and FIG. 5 shows a combination of a reversible flat key and a cylinder lock in accordance with a second embodiment of the invention.

With reference to the cited figures, a key 1 for a lock 2 is illustrated. In the following reference will be made to a preferred solution that includes a reversible flat key and a cylinder lock.

The scope of the invention can however also be extended to a key of a different type, for example a bitted key, or a non-reversible key.

The key 1 comprises a grip 3 and a shaft 4 bearing the key 1 bit, adapted to interact with the tumbler elements present in the lock 2.

The bit of the key 1 comprises, in a known way, on each of the two opposite main faces 5 of the shaft 4 of the key 1, one or more rows of recesses 6 aligned according to the longitudinal axis of the shaft 4.

It is possible, as illustrated, for the bit to comprise, in a known way, on each of the two opposite secondary lateral faces 7 of the shaft 4, one or more rows of recesses 8 aligned according to the longitudinal axis of the shaft 4.

A lever 9 having a first arm 10 for starting movement and a second arm 11 for activating a tumbler element of the lock 2 is advantageously mounted on each main face 5 of the shaft 4.

It is understood that in a case in which the key is not reversible, only one lever 8 is included, mounted selectively on one of the two main faces 5 of the shaft 4 of the key 1.

Alternatively the lever 9, in a different embodiment of the invention, can be mounted on a secondary face 7 of the shaft 4 of the key 1.

Each lever 9 is pivoted by a pin 12 to the shaft 4 of the key 1.

The oscillating axis of the lever 9 is transversal to the longitudinal axis of the shaft 4 of the key 1.

In particular, the oscillating axis of the lever 9 is perpendicular to the longitudinal axis of the shaft 4 of the key 1 and to the opposite secondary faces 7 of the shaft 4 of the key 1.

The first lever arm 10 and the second lever arm 11 are situated on the same main face 5 of the shaft 4 of the key 1.

The lever 9 is housed in a groove 13 of a main face 5 of the shaft 4 of the key 1. The groove 13 extends longitudinally along the shaft 4 of the key 1.

In particular the groove 13 extends up to the end 14 of the shaft 4 of the key 1 opposite the grip 3 of the key 1.

The groove 13 has a width, length and depth that are such as to completely house the lever 9 inside thereof when the lever 9 assumes an idle position illustrated for example in FIG. 1.

The groove 13 has a depth dimension in direction of the thickness of the shaft 4 lower than the thickness of the shaft 4 so that a bottom wall of the groove 13 is defined separating the lever 9 from the main face 5 of the shaft 4 opposite to that one where the groove 13 is located.

The lever 9 also has an active position in which it projects with the second arm 11 outside of the groove 13.

The key 1 has a suitable releasable retaining means of the lever 9 in an idle position.

The retaining means is preferably magnetic.

More precisely, the retaining means comprises a permanent magnet 15 housed in a suitable seating 16 fashioned inside of the groove 13.

The permanent magnet 15 is adapted to interact with the lever 9 which, in the example, must be made of a magnetic material, preferably a ferromagnetic material.

The second arm 11 of the lever 9 advantageously has a greater length than the first arm 10 of the lever 9 so as to amplify the displacement of the tumbler element.

In other embodiments of the invention, it is however possible for the length of the two lever arms to be equal or for the second lever arm 11 to be of a shorter length than the first lever arm 10.

The key 1 operates in combination with a cylinder lock having a stator 22 which houses a cylindrical rotor 17 having a slot 23 for introduction of the key 1.

The cylindrical rotor 17 of the lock 2 houses a series of tumbler elements formed by pins 18, 19, 19', 20 of different types and a sensor 21 able to interact with the first lever arm 10.

The tumbler pins 18, 19, 19', 20 and the sensor 21 are aligned according to the axis of the cylindrical rotor 17 and in particular are positioned at a same diameter plane as the cylindrical rotor 17 on the same side as the slot 23 for introduction of the key 1.

The tumbler pins 18, 19, 19', 20 are mobile along radial channels of the cylindrical rotor 17 which at one end open on the annular part 22*a* of the stator 22 and at the other end open on the slot 23 for the key 1.

The tumbler pin 18 is a passive pin constituted by a single piece having truncoconical ends.

When the key 1 is inserted in the slot 23 (FIGS. 4*a*, 5), by effect of the interaction of the pin 18 with the bit of the key 1 the pin 18 is free to translate and free the end thereof from the relative engaging seating 29 included on the internal side of the annular part 22*a* of the stator 22. This condition thus enables the rotation of the cylindrical rotor 17.

The tumbler pin 19 comprises a male part 19*a* and a female part 19*b* engaged with the male part 19*a* with the interposing of an elastic element 19*c*. The female part 19*b* has a truncoconical end adapted to interact with the bit of the key 1 and an end for introduction of said male part 19*a*. The male part 19*a* has an end that is internal of the female part 19*b* and a truncoconical end that is external of the female part 19*b* and fittable in a seating 24 having a complementary shape located on an internal side of an annular part 22*a* of the stator 22. The male part 19*a* further has a perimeter gully 19*a*'. When the key 1 is not inserted in the slot 23 (FIG. 4*b*) the truncoconical end of the male part 19*a* is fitted in the housing 24 thereof and the female part 19*b* by effect of the action of the elastic element 19*c* is protracted from the male part 19*a* and assumes a position wherein the introduction end thereof for the male part 19*a* is aligned to the gully 19*a*' of the male part 19*a*. In this position, if an attempt is made to rotate the cylindrical rotor 17, the male part 19*a* is free to angularly oscillate so as to wedge between the cylindrical rotor 17 and the stator 22 and prevent the rotation of the cylindrical rotor 17. On the contrary, when the key 1 is inserted in the slot 23 (FIGS. 4*a*, 5) the truncoconical end of the male part 19*a* is fitted in the housing 24 thereof but the female part 19*b* by effect of the interaction with the bit of the key 1 is retracted towards the male part 19*a* and assumes a position wherein the introduction end thereof for the male part 19*a* is offset from the gully 19*a*' of the male part 19*a*. In this position the female part 19*b* functions as a translation guide for the male part 19*a*. Therefore, if an attempt is made to rotate the cylindrical rotor 17, the male part 19*a* is guided to translate in the female part 19*b* up until the truncoconical end of the male part 19*a* exits from the seating 24 thereof and retracts into the radial channel of the cylindrical rotor 17. In this case therefore the rotation of the cylindrical rotor 17 can take place.

The solution illustrated in FIGS. 4*a* and 4*b* includes a tumbler pin 20 constituted by a single piece adapted to interact with a counter-pin 25 movable in opposition to and by action of an elastic element 26 in a seating 27 fashioned on the internal side of the annular part 22*a* of the stator 22. When the key 1 is not inserted in the slot 23 (FIG. 4*b*) the counter-pin 25, by effect of the action of the elastic element 26, is protracted in part into the radial channel which houses the pin 20. In this position, if an attempt is made to rotate the cylindrical rotor 17, the counter-pin 25 arranged straddling the cylindrical rotor 17 and the stator 22 prevents the rotation of the cylindrical rotor 17. On the contrary, when the key 1 is inserted in the slot 23 (FIG. 4*a*), by effect of the interaction of the pin 20 with the bit of the key 1, the point of contact between the pin 20 and the counter-pin 25 positions at the cylindrical interface surface between the annular part 22*a* of the stator 22 and the cylindrical rotor 17. In this case therefore the rotation of the cylindrical rotor 17 can take place.

The solution illustrated in FIG. 5, on the other hand, includes a tumbler element 19' that is equivalent in terms of functioning to the tumbler element 19 but which differs therefrom structurally in terms of the flat, rather than truncoconical, shape of an end of the female part.

The tumbler element of the lock can comprise tumbler elements that might be different in terms of arrangement, number and type to those described in the foregoing.

In the lock illustrated in FIGS. 4*a* and 4*b*, the sensor 21 is formed by a fixed pin positioned beyond the last tumbler element on the side of the cylindrical rotor 17 opposite the cylindrical rotor for introduction of the key 1.

In this case the lever 9 has the first lever arm 10 in a proximal position to the end 14 of the shaft 4 of the key 1 and the second lever arm is situated in a distal position from the end 14 of the shaft 4 of the key 1.

The sensor 21 can also however be different in terms of arrangement and type and the key 1 must in any case be conformed in a congruent way.

With reference, instead, to the solution illustrated in FIG. 5, the lever 9 has the first lever arm 10 in a distal position from the end 14 of the shaft 4 of the key 1 and the second lever arm is situated in a proximal position to the end 14 of the shaft 4 of the key 1, as the sensor 21 is now positioned before the final tumbler element 19'.

In the situation illustrated in FIG. 5, the structure of the sensor 21 is also different.

In fact, the sensor 21 in this case includes a pin 21*a* mobile in a radial channel 30 of the cylindrical rotor 17 in contrast with and by action of an elastic element 21*b* interposed between the mobile pin 21*a* and a housing 21*c* fixed in said radial channel 30.

The operation of the lever 9 is as follows.

Before the introduction of the key 1 in the slot 23 of the cylindrical rotor 17 the permanent magnet 15 retains the lever 9 in the idle position completely inside of the groove 13.

When the key 1 is inserted in the slot 23 of the cylindrical rotor 17, the first lever arm 10 interacts with the sensor 21 from which the first lever arm 10 receives a force that overcomes the magnetic retaining force of the lever 9 in the idle position and generates on the lever 9 a rotation momentum due to which the lever 9 is borne into the active position.

By effect of the rotation of the lever 9 the second lever arm 11 activates a tumbler element, in particular the tumbler element 20 in the solution illustrated in FIGS. 4*a* and 4*b* and the tumbler element 19' in the solution illustrated in FIG. 5.

The tumbler element activated by the lever 9 is moved from the blocked position of the rotation of the cylindrical rotor 17 to the position that enables the rotation of the cylindrical rotor 17.

More in general, by effect of the interaction with the bit of the key 1, all the other tumbler elements are moved into the position that enables the rotation of the cylindrical rotor 17.

The tumbler pin activated by the lever 9 can naturally also be a pin having the structure of the pin 19, or another pin.

The key for a lock as conceived herein is susceptible of numerous modifications and variants, all falling within the scope of the inventive concept; furthermore, all the details are replaceable by technically equivalent elements.

In practice the materials used, as well as the dimensions, can be any according to the needs and the state of the art.

The invention claimed is:

1. A key for a lock, comprising a grip, a shaft having two opposite main faces and two opposite secondary lateral faces, at least a lever having a first arm for starting movement and a second arm for activating a tumbler element of the lock, said lever being pivoted to the shaft of the key with an oscillating axis thereof being transversal to the longitudinal axis of the shaft of the key, wherein said first lever arm and said second lever arm are located on a same main face of the shaft of the key, said lever being housed in a groove of said main face extending longitudinally along said shaft up to the end of the shaft opposite to the grip of the key, wherein in an idle position thereof, said lever is positioned entirely internally of said groove, and wherein the key further comprises releasable retaining means of said lever in an inactive position.

2. The key for a lock according to claim 1, wherein said retaining means are magnetic.

3. The key for a lock according to claim 2, wherein said magnetic retaining means comprise a permanent magnet housed in said groove.

4. The key for a lock according to claim 1, wherein in an active position said lever projects with said second arm externally of said groove.

5. The key for a lock according to claim 1, wherein said second arm has a greater length than said first arm so as to amplify the displacement of the tumbler element.

6. The key for a lock according to claim 1, wherein the key is a reversible flat key in which said face on which said first lever arm and said second lever arm are located is one of the two main opposite faces.

7. The key for a lock according to claim 1, wherein said groove has a depth dimension in direction of the thickness of the shaft lower than the thickness of the shaft so that a bottom wall of the groove is defined separating the lever from the main face of the shaft opposite to that one where the groove is located.

8. A combination of a cylinder lock and a reversible flat key according to claim 1, wherein said tumbler element is a tumbler pin located in a cylindrical rotor of the lock.

9. The combination of a cylinder lock and a reversible flat key according to claim 8, wherein said first lever arm interacts with a sensor located in the cylindrical rotor of the lock.

10. The combination of a cylinder lock and a reversible flat key according to claim 9, wherein said tumbler pin and said sensor are positioned at a same diametric plane of the cylindrical rotor of the lock on the same side as a slot for introduction of the key.

11. The combination of a cylinder lock and a reversible flat key according to claim 8, wherein said tumbler pin comprises a male part having a perimeter gully and a female part engaged with said male part with the interposing of an elastic element, said female part having an end able to interact with said lever and an end for introduction of said male part, said male part having an end that is internal of said female part and a truncoconical end that is external of said female part and fittable in a seating having a complementary shape located on an internal side of an annular part of a stator of said lock.

12. The combination of a cylinder lock and a reversible flat key according to claim 8, wherein said tumbler pin comprises a single piece interacting with a counter-pin movable in opposition and by action of an elastic element in a seating fashioned on an internal side of an annular part of a stator of said lock.

* * * * *